US007832369B2

(12) United States Patent
Schafer et al.

(10) Patent No.: US 7,832,369 B2
(45) Date of Patent: Nov. 16, 2010

(54) DEVICE FOR MODIFYING THE CONTROL TIMES OF AN INTERNAL COMBUSTION ENGINE

(75) Inventors: Jens Schafer, Herzogenaurach (DE); Mike Kohrs, Wilthen (DE)

(73) Assignee: Schaeffler Technologies GmbH & Co., Herzogenaurach (DE)

( * ) Notice: Subject to any disclaimer, the term of this patent is extended or adjusted under 35 U.S.C. 154(b) by 605 days.

(21) Appl. No.: 11/721,823

(22) PCT Filed: Nov. 12, 2005

(86) PCT No.: PCT/EP2005/012155

§ 371 (c)(1),
(2), (4) Date: Jun. 15, 2007

(87) PCT Pub. No.: WO2006/074745

PCT Pub. Date: Jul. 20, 2006

(65) Prior Publication Data

US 2009/0250027 A1 Oct. 8, 2009

(30) Foreign Application Priority Data

Dec. 23, 2004 (DE) ..... 10 2004 062 035

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 4,294,218 | A | 10/1981 | King et al. | |
| 6,523,512 | B2 * | 2/2003 | Axmacher et al. | 123/90.17 |
| 7,137,370 | B2 * | 11/2006 | Axmacher et al. | 123/90.17 |

FOREIGN PATENT DOCUMENTS

| | | |
|---|---|---|
| DE | 10038354 | 2/2002 |
| DE | 10222475 | 4/2003 |
| DE | 10257706 | 1/2004 |
| DE | 10248355 | 4/2004 |
| WO | 2006018080 | 2/2006 |

* cited by examiner

*Primary Examiner*—Zelalem Eshete
(74) *Attorney, Agent, or Firm*—Volpe and Koenig, PC

(57) ABSTRACT

A device (1) for modifying the control times of an internal combustion engine having a drive wheel (13), an output element (4), and a swashplate gear mechanism (2) is provided. The torque of the crankshaft is transmitted to the drive wheel (13) via a primary drive and is transmitted on to the output element (4) via the swashplate gear mechanism (2), with the output element (4) being connected in a fixed manner to the camshaft (11). The swashplate gear mechanism (2) allows the drive wheel (13) to be rotated relative to the output element (4) allowing a continuous phase shift of the camshaft (11) relative to the crankshaft. In order carry out this function, the drive wheel (13) is rotatably supported by the output element (4). An inexpensive and easy way to supply the swashplate gear mechanism (2) and the radial bearing (28) with lubricant is provided.

5 Claims, 4 Drawing Sheets

DEVICE FOR MODIFYING THE CONTROL TIMES OF AN INTERNAL COMBUSTION ENGINE

BACKGROUND

The invention relates to a device for modifying the control times of gas-exchange valves of an internal combustion engine.

In internal combustion engines, camshafts are used for actuating the gas-exchange valves. Camshafts are mounted in the internal combustion engine such that cams located on these camshafts contact cam followers, for example, cup tappets, rocker arms, or finger levers. If the camshaft is set in rotation, then the cams roll on the cam followers, which in turn actuate the gas-exchange valves. Thus, both the opening period and also the amplitude, but also the opening and closing times of the gas-exchange valves, are set by the position and the shape of the cams.

Modern engine concepts allow variable valve train designs. On one hand, the valve lift and valve opening period should be made variable up to complete shutdown of individual cylinders. For this purpose, concepts such as switchable cam followers, variable valve trains, or electrohydraulic or electrical valve actuators are provided. Furthermore, it has been shown to be advantageous to be able to influence the opening and closing times of the gas-exchange valves during the operation of the internal combustion engine. It is likewise desirable to be able to influence the opening or closing times of the intake or exhaust valves separately, in order, for example, to be able to selectively set a defined valve overlap. By setting the opening or closing times of the gas-exchange valves depending on the current engine-map range, for example, the current rotational speed or the current load, the specific fuel consumption can be lowered, which has a positive effect on the exhaust-gas behavior and increases the engine efficiency, the maximum torque, and the maximum output.

The described variability in the gas-exchange valve time control is implemented through a relative change of the phase position of the camshaft relative to the crankshaft. Here, the camshaft is usually in a driven connection with the crankshaft via a chain drive, belt drive, gearwheel drive, or equivalent drive concepts. Between the chain drive, belt drive, or gearwheel drive driven by the crankshaft and the camshaft there is a camshaft adjuster, which transmits the torque from the crankshaft to the camshaft. Here, this device for modifying the control times of the internal combustion engine is constructed such that during the operation of the internal combustion engine, the phase position between the crankshaft and camshaft is held reliably and, if desired, the camshaft can be rotated within a certain angular range relative to the crankshaft.

In internal combustion engines with separate camshafts for the intake and exhaust valves, these can each be equipped with a camshaft adjuster. Therefore, the opening and closing times of the intake and exhaust gas-exchange valves can be shifted in time relative to each other and the valve overlaps are set selectively.

The base of modern camshaft adjusters is generally located on the drive-side end of the camshaft. It is comprised of a crankshaft-fixed drive wheel, a camshaft-fixed driven element, and an adjustment mechanism transmitting the torque from the drive wheel to the driven part. The drive wheel can be constructed as a chain, belt, or gearwheel and is locked in rotation with the crankshaft by means of a chain, belt, or gearwheel drive. The adjustment mechanism can be operated electromagnetically, hydraulically, or pneumatically. Mounting the camshaft adjuster on an intermediate shaft or supporting it on a non-rotating component is similarly conceivable. In this case, the torque is transmitted via additional drives to the camshaft.

Electrically operated camshaft adjusters are comprised of a drive wheel, which is in driven connection with the crankshaft of the internal combustion engine, a driven part, which is in driving connection with a camshaft of the internal combustion engine, and adjustment gearing. The adjustment gearing involves a triple-shaft gear mechanism, with three components rotating relative to each other. Here, the first component of the gearing is locked in rotation with the drive wheel and the second component is locked in rotation with the driven part. The third component is constructed, for example, as a toothed component, whose rotational speed can be regulated via a shaft, for example, by means of an electric motor or a braking device.

The torque is transmitted from the crankshaft to the first component and from there to the second component and thus to the camshaft. This happens either directly or under intermediate connection of the third component.

Through suitable regulation of the rotational speed of the third component, the first component can be rotated opposite the second component and thus the phase position between the camshaft and crankshaft can be changed. Examples for such triple-shaft gear mechanisms are internal eccentric gear mechanisms, double-internal eccentric gear mechanisms, shaft gear mechanisms, swashplate gear mechanisms, or the like.

For controlling the camshaft adjuster, sensors detect the characteristic data of the internal combustion engine, for example, the load state, the rotational speed, and the angular positions of the camshaft and crankshaft. This data is fed to an electronic control unit, which controls the adjustment motor of the camshaft adjuster after comparing the data with an engine-map range of the internal combustion engine.

From DE 102 22 475 a device for modifying the control times of an internal combustion engine is known, in which the torque transfer from the crankshaft to the camshaft and the adjustment process are realized by means of a swashplate gear mechanism. The device essentially comprises a drive wheel, a camshaft-fixed driven element and a swashplate. The drive wheel is in driven connection with a crankshaft and is constructed in one piece with a housing. The swashplate is supported on an adjustment shaft at a defined contact angle and is provided with several pins. Each pin engages in an elongated hole formed in the housing. The torque of the crankshaft is transmitted via the drive wheel, the housing, and the pins to the swashplate.

The swashplate and the driven element are each provided with a conical gearwheel in the form of a toothed ring on their axial side surfaces facing the other component. Here, the swashplate and the driven element are arranged so that, due to the support of the swashplate on the adjustment shaft at a certain contact angle, an angular segment of the teeth of the swashplate engages in an angular segment of the teeth of the driven element. Here, there is a difference in the number of teeth in the conical gearwheels.

The adjustment shaft is in driven connection with a drive unit, for example, an electric motor, which can be driven at continuously variable rotational speeds. A rotation of the adjustment shaft relative to the driven element leads to a wobbling rotation of the swashplate and thus to a rotation of the engaged angle segment relative to the driven element and the swashplate. Due to the difference in the number of teeth of the conical gearwheels, this leads to relative rotation of the camshaft relative to the crankshaft.

The drive wheel or the housing is supported on an axial shoulder of the driven element so that it can rotate relative to this element. The conical gearwheel teeth of the driven element are constructed on a teeth carrier, wherein the teeth carrier is mounted before the shoulder in the axial direction. The teeth carrier and a cover screwed to the drive wheel form an axial bearing for the drive wheel or the housing. Here, the cover is fixed in the axial direction by the driven element on one side and by the camshaft on the other side.

The radial bearing position between the driven element and the housing or the drive wheel is supplied with lubricant via channels, which are formed as radial bores within the driven element. These bores extend from the hub of the driven element to its bearing surface. Supplied via a lubricant line, which is formed in the hub of the driven element and which supplied with lubricant via the camshaft, the lubricant is led to the bores and from there to the radial bearing position. From the radial bearing position, the lubricant is led into the swashplate gear mechanism, whereby the intermeshing gear pairs are supplied with lubricant.

This embodiment of the lubricant supply overcomes a few disadvantages in the production of the driven element. For one, the relatively long bores must be formed in the driven element, after its shaping, by means of small diameter drills. This represents a production-intensive processing step, which leads to high production costs of the component. In addition to the high costs for the construction of the lubricant channels, in this embodiment the condition that the driven element must have a certain wall thickness has a negative effect, in order to keep the space available for the lubricant bores. This produces a relatively high mass and relatively high axial installation space requirements for the device. Furthermore, during the formation of the lubricant channels there is the risk that the drill will break off within the borehole, whereby the processing reliability of the production process of the driven element is negatively affected. Also conceivable is that production residue, such as shavings or bore cuttings, remain in the relatively long boreholes, which can damage the bearings or the teeth when the device is operating.

SUMMARY

The invention is based on the objective of providing a device for modifying the control times of gas-exchange valves of an internal combustion engine, wherein the lubricant supply to the swashplate gear mechanism and the radial bearing position between the driven element and the housing or drive wheel can be produced economically and with more process reliability.

In a first embodiment of a device for modifying the control times of gas-exchange valves of an internal combustion engine with a drive wheel in drive connection with a crankshaft and with a swashplate gear mechanism, which has at least a housing, a swashplate, and a driven element in driving connection with a camshaft, wherein the housing and the driven element define a ring-shaped hollow space, in which the swashplate is arranged and wherein the drive wheel and/or the housing is supported on a radial bearing so that it can rotate relative to the driven element by means of this radial bearing, the objective is met according to the invention in that lubricant is fed from the region of the ring-shaped hollow space of the swashplate gear mechanism to the radial bearing.

Here, the radial bearing can be a roller bearing or a slide bearing, wherein in the case of a slide bearing a first radial bearing surface is formed on an outer casing surface of the driven element and a second radial bearing surface is formed on an inner casing surface of the housing or the drive wheel.

In the embodiment according to the invention, the device is comprised of a drive wheel formed as a belt, chain, or gearwheel and a swashplate gear mechanism. The swashplate gear mechanism comprises, among other things, a housing, which is locked in rotation with the drive wheel, a swashplate, a driven element, which is locked in rotation with a camshaft, and an adjustment shaft, whose rotational speed can be regulated, for example, by means of an electric motor. Torque is transmitted from the crankshaft to the drive wheel by means of a belt, chain, or gearwheel drive, and thus to the housing. The housing is in active connection with the swashplate by means of a pin coupling or a geared component. As the geared component, for example, a conical gear is conceivable, which is constructed in one piece with the housing or is connected to this by an attachment means. The pin coupling or the geared component transmits the torque transmitted to the drive wheel from the crankshaft to the swashplate, which is supported on an adjustment shaft. The swashplate is arranged on the adjustment shaft at a defined contact angle relative to the driven element.

On an axial side surface of the swashplate, a toothed ring extending in the peripheral direction is formed. Furthermore, a ring-shaped, radially outer region of the driven element is constructed as a gearing carrier, on which a toothed ring is likewise formed. The toothed ring of the swashplate engages along a defined angular section into the toothed ring of the driven element. The size of this angular section is dependent, among other things, on the contact angle of the swashplate.

The crankshaft torque is transmitted by means of the drive wheel, the housing, the pin coupling, or the geared component to the swashplate and from there to the driven element and finally to the camshaft. The toothed rings of the swashplate and the driven element or the swashplate and the geared component have different numbers of teeth. It is also conceivable to form the intermeshing toothed rings of both gear pairs with different numbers of teeth. If the adjustment shaft rotates at the rotational speed of the drive wheel, then the phase position between the crankshaft and camshaft is maintained. If there is a difference between the rotational speed of the adjustment shaft and the rotational speed of the drive wheel, the phase position between the camshaft and the crankshaft is changed. Here, the housing and the drive wheel rotate relative to the driven element, which supports the housing or drive wheel in the radial direction.

To keep the wear, the friction, and the development of noise in the swashplate gear mechanism low, the swashplate gear mechanism is supplied continuously with lubricant. This can be realized, for example, by feeding motor oil or by filling a sealed device with lifetime lubrication.

By utilizing the lubricant present in the swashplate gear mechanism, the necessity for additional lubricant feed lines, for example, through the camshaft, is eliminated. Furthermore the long, thin bores between the hub of the driven element and the radial bearing position between the driven element and the housing or drive wheel are eliminated. This increases the processing reliability and decreases the costs of the production of the driven part. Furthermore, the mass and the axial installation space requirements of the driven element can be reduced to a minimum. Here, the supply of lubricant both to a slide bearing and also to a roller bearing is possible.

In an advantageous improvement of the invention, the driven element is provided with at least one lubricant channel, which connects the annular hollow space to the second radial bearing surface and by means of which the lubricant supply to the radial bearing is realized. Here it can be provided that the lubricant channel is realized as a bore. In this case, the driven element is provided in the region of the gearing carrier with a bore, which penetrates its radial bearing surface. Due to the high rotational speeds of the device, lubricant entering into the swashplate gear mechanism is fed radially outwards. Here, it enters into the bores formed in the driven element and is fed to the radial bearing position due to centrifugal force. The lengths of the bores can be kept short in this case, whereby the process reliability is not endangered and the costs are kept low.

Alternatively, it can be provided that the lubricant channel is realized by a tooth gap of a toothed ring of the driven element, wherein the tooth gap extends up to the first radial bearing surface and intersects this surface. In this embodiment, the drive wheel or the housing is supported directly on the gearing carrier of the driven element and the feeding of lubricant can be realized through a special construction of the gearing. For this purpose, at least one tooth gap of the toothed ring of the gearing carrier extends in the radial direction outwards to the radial bearing surface of the driven element. Here, the tooth gap intersects the radial bearing surface, whereby the feeding of lubricant is guaranteed. In this connection, it is imaginable to allow only one tooth gap or all of the tooth gaps to intersect the radially outer edge of the driven element. Also conceivable would be forming the lubricant-leading tooth gaps in periodic intervals on the toothed ring.

The advantage of this embodiment is provided in that such gearing can be produced without significant extra costs. The process reliability is not negatively affected and production-related residues, which could damage the gearing components, are not produced.

In an alternative construction of the invention, it is provided that the lubricant channel is realized by a radial groove, which is formed in the housing or the driven element and which extends from the first radial bearing surface up to the hollow space. In this embodiment, the housing is formed with a radially inwardly extending projection, wherein an axial side surface of the projection contacts an axial side surface of the driven element. The two side surfaces form an axial bearing, which receives axial forces acting on the housing. Radial grooves, which extend from the hollow space to the radial bearing and which allow a lubricant flow from the hollow space to the radial bearing, are provided on one of the two contact surfaces of the components. Here, the grooves can be formed both on the projection of the housing and also on the driven element. The grooves can be formed further during the shaping process of the relevant component, whereby during the production no additional costs are incurred.

In one advantageous improvement of the invention, the lubricant channel opens on the radial bearing side into a lubricant pocket, which is formed on the first radial bearing surface. Here, the lubricant pocket can be formed as a ring groove, which extends around the first radial bearing surface in the peripheral direction. Alternatively, the lubricant channel can open on the radial bearing side into a lubricant pocket, which is formed on the second radial bearing surface, wherein the lubricant pocket is formed as a ring groove, which extends around the second radial bearing surface in the peripheral direction.

The lubricant pocket functions as a lubricant reservoir and guarantees the formation of a constant lubricant film between the radial bearing surfaces. One or more lubricant pockets, which can extend in the axial direction over the entire radial bearing region or only a part of this region, can be formed spaced apart in the peripheral direction. Advantageously, for each lubricant channel a lubricant pocket is formed. Alternatively, the lubricant pocket can be formed as a ring groove, which is formed on the inner casing surface of the housing or the drive wheel or on the outer casing surface of the driven element. The ring groove or the lubricant pockets can be formed economically in the original shaping process of the components.

In another embodiment of a device for modifying the control times of gas-exchange valves of an internal combustion engine with a swashplate gear mechanism, which has at least one swashplate and a driven element in drive connection with a camshaft, wherein the swashplate is supported on an adjustment shaft, the objective is met according to the invention in that lubricant is fed to the swashplate gear mechanism via a radial gap between the driven element and the adjustment shaft. In this embodiment, lubricant enters into the hub of the device along a central channel and is led via radial openings to a ring-shaped radial gap, which is limited in the axial direction on one side by the driven element and on the side by the adjustment shaft. The lubricant is thus led via short bores, impressions, or other channels from the hub of the device directly into the hollow space, where it is led to the bearing position and to engaged gearing pairs. Long, thin bores, which can lead to production errors during manufacturing, are eliminated, whereby rejects in the production are reduced and production costs are reduced.

In an advantageous improvement of the invention, the radial gap is formed such that it acts as a choke. Here, the width of the radial gap can be less than or equal to 2 mm.

The choke has the function that only a required amount of lubricant is fed to the swashplate gear mechanism. Therefore, efficiency losses of the device by the presence of too much lubricant in the device are prevented and the lubricant pump is loaded only to the extent necessary. In the control case, the lubricant supply is realized by means of a motor oil gallery, which is supplied with motor oil by means of an oil pump. In this case, the oil pump including components of the internal combustion engine to be lubricated is supplied with motor oil and possible additional hydraulic functions are taken over. In this case, it is necessary to limit the pressure drop in the motor oil circuit to the device to a minimum. This can be realized in a simple way through the construction of the radial gap between the driven element and the adjustment shaft. By setting the width of the radial gap between both components, the throttling effect can be selectively set. Here, a small width corresponds to a high throttling effect or a low flow rate of lubricant. With increasing width, the throttling effect decreases or the flow rate increases.

In addition, the adjustment shaft can be supported by means of second roller bearing on a shaft, the lubricant on an outer limiting surface of the shaft can enter into the radial gap, and lubricant is fed to the second roller bearing due to the throttling effect of the radial gap. The support of the adjustment shaft on a camshaft-fixed shaft reduces the loading on the adjustment shaft, whereby the lifetime of the device increases. Advantageously, the adjustment shaft is supported on the shaft by means of the roller bearing. To guarantee a sufficient supply of lubricant to the roller bearing, the lubricant flow flowing in the device can be guided to this roller bearing. In the region of the roller bearing, sufficient lubricant pressure is established due to the throttling effect through the radial gap, in order to also establish a lubricant flow through the roller bearing. Therefore, no additional measures are necessary to supply this bearing with lubricant.

BRIEF DESCRIPTION OF THE DRAWINGS

Additional features of the invention emerge from the following description and the associated drawings, in which embodiments of the invention are illustrated schematically. Shown are.

DETAILED DESCRIPTION OF THE PREFERRED EMBODIMENTS

Figure 1:
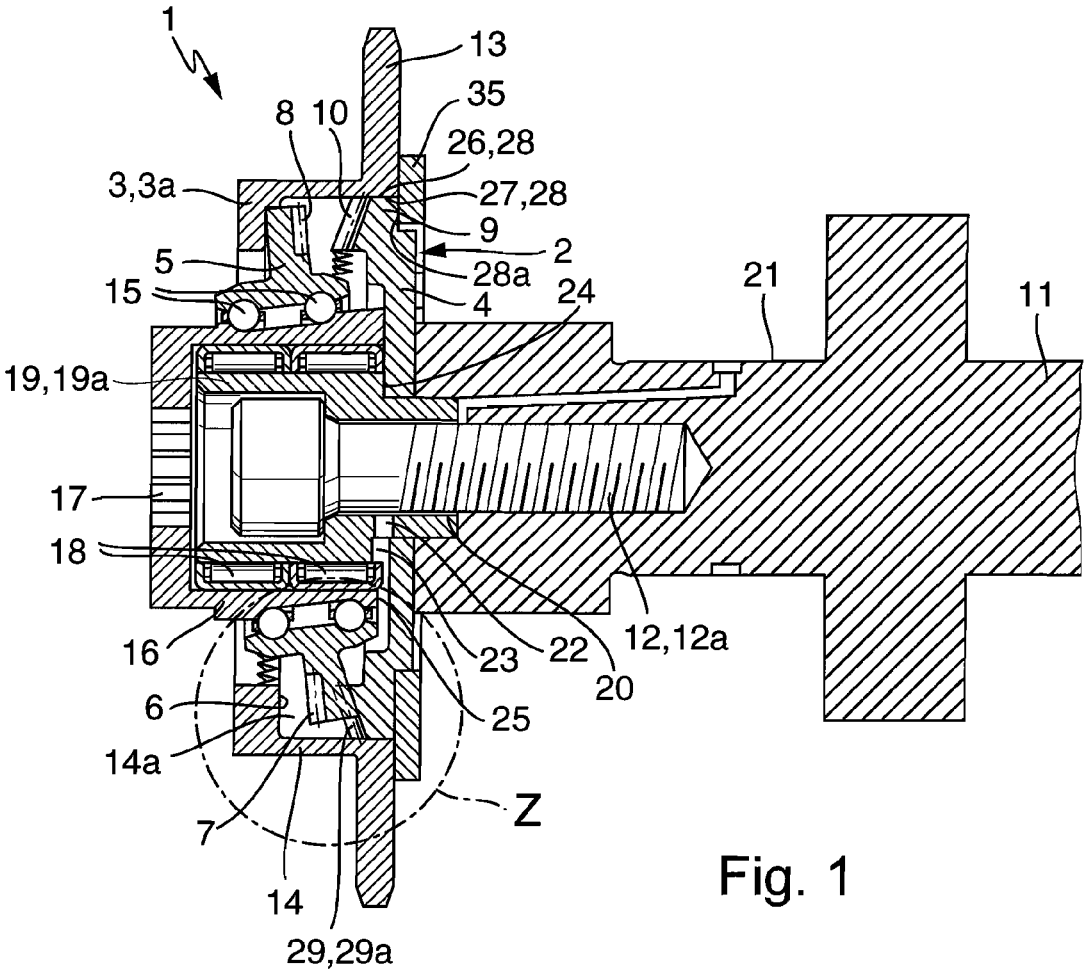
FIG. 1 a longitudinal cross-sectional view through a first embodiment according to the invention of a device for modifying the control times of gas-exchange valves of an internal combustion engine, FIG. 2 an enlarged view of the detail Z shown in FIG. 1 for a second embodiment according to the invention of a device for modifying the control times of gas-exchange valves of an internal combustion engine, FIG. 3 a longitudinal cross-sectional view through a third embodiment according to the invention of a device for modifying the control times of gas-exchange valves of an internal combustion engine, FIG. 4 a perspective view of the housing of the embodiment from FIG. 3.
Figure 1A:
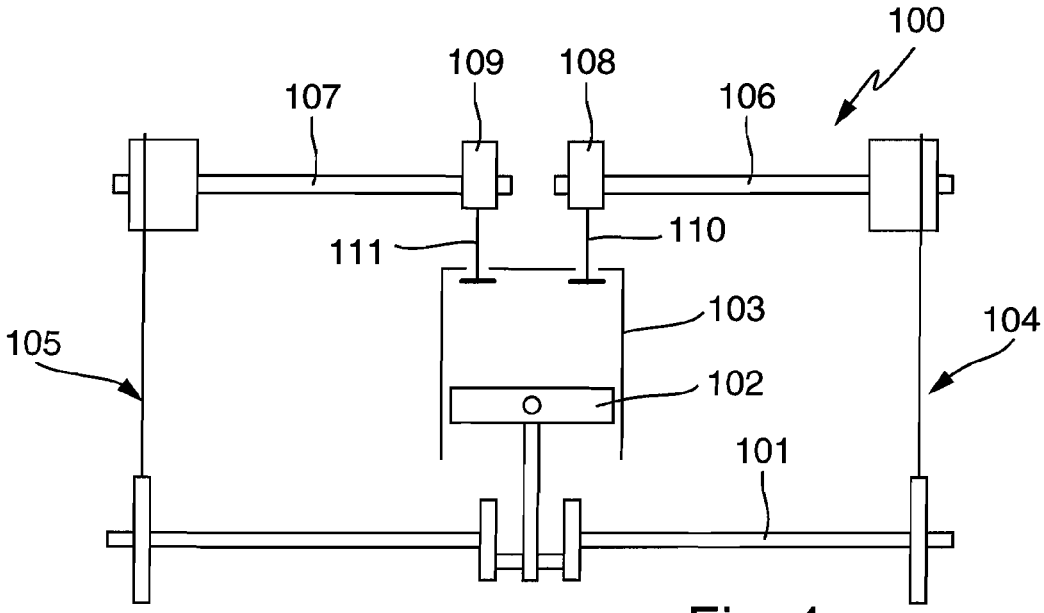
FIG. 1*a* a schematic view of an internal combustion engine.

In FIG. 1*a*, an internal combustion engine 100 is sketched, wherein a piston 102 that is connected to a crankshaft 101 is shown in a cylinder 103. The crankshaft 101 is connected in the shown embodiment via a power-transmission means drive 104 and 105 to an intake camshaft 106 and the exhaust camshaft 107, respectively, wherein a first and a second device 1 can provide for a relative rotation between the crankshaft 101 and camshafts 106, 107. Cams 108, 109 of the camshafts 106, 107 actuate an intake gas-exchange valve 110 and the exhaust gas-exchange valve 111, respectively.

FIG. 1 shows an embodiment of a device 1 according to the invention for modifying the control times of an internal combustion engine 100. The device 1 comprises, among other things, a swashplate gear mechanism 2 comprised of a toothed component 3*a*, a driven element 4, and a swashplate 5. The toothed component 3*a* is constructed in the shown embodiment as a conical gearwheel 3. A first toothed ring 6 constructed as conical gearwheel teeth is formed on an axial side surface of the conical gearwheel 3. Furthermore, on the axial side surfaces of the swashplate 5 there is a second and a third toothed ring 7, 8, wherein the toothed rings 7, 8 in this embodiment are each constructed similarly as conical gearwheel teeth. Here, the second toothed ring 7 is constructed on the axial side surface facing the conical gearwheel 3 and the toothed ring 8 is constructed on the axial side surface of the swashplate 5 facing the driven element 4. The radial outer section of the driven element 4 is constructed as toothed carrier 9, on whose axial side surface facing the swashplate 5 there is a fourth toothed ring 10. The fourth toothed carrier 10 is constructed in this embodiment likewise as conical gearwheel teeth.

The driven element 4 is locked in rotation with a camshaft 11. The connection between the driven element 4 and camshaft 11 is realized in the shown embodiment by means of a first attachment means 12, here an attachment screw 12*a*. A force, friction, firmly bonded or form fit connection methods are also conceivable.

A drive wheel 13 is in active connection with a not-shown primary drive, by means of which a torque is transmitted from a crankshaft 101 to the drive wheel 13. Such a primary drive can be, for example, a chain, belt, or gearwheel drive. The drive wheel 13 is locked in rotation with a housing 14, and the housing 14 is in turn locked in rotation with the conical gearwheel 3. In the embodiment shown in FIG. 1, these components are constructed in one piece. Alternatively, the housing 14 can be connected to the conical gearwheel 3 and/or to the drive wheel 13 with a force, friction, firmly bonded or form fit.

The conical gearwheel 3 and the driven element 4 are parallel to each other and are spaced apart in the axial direction. Together with the housing 14, the conical gearwheel 3 and the driven element 4 form a ring-shaped hollow space 14*a*, in which the swashplate 5 is arranged. By means of first roller bearings 15, the swashplate 5 is supported at a defined contact angle to the conical gearwheel 3 and the driven element 4 on an adjustment shaft 16. The essentially pot-shaped adjustment shaft 16 is provided with a coupling element 17, in which a not-shown shaft of a similarly not-shown device engages, with which the rotational speed of the adjustment shaft 16 can be regulated. In this embodiment, the adjustment shaft 16 is to be driven by means of a not-shown electric motor, wherein a not-shown shaft of the electric motor interacts with the coupling element 17. The adjustment shaft 16 is supported by means of a second roller bearing 18 on a shaft 19*a* locked in rotation with the camshaft 11 and constructed in the present embodiment as a hollow shaft 19. Also conceivable is the support of the adjustment shaft 16 on a screw head of the attachment screw 12*a* and/or a support of the swashplate 5 on the adjustment shaft 16 by means of a slide bearing.

The swashplate 5 arranged at a defined contact angle on the adjustment shaft 16 engages with the second toothed ring 7 in the first toothed ring 6 of the conical gearwheel 3 and with the third toothed ring 8 in the fourth toothed ring 10 of the driven element 4. Here, the toothed rings 6, 7, 8, 10 engage only at a certain angular range, wherein the size of the angular range is dependent on the contact angle of the swashplate 5.

By means of the engagement of the toothed rings 6, 7, 8, 10, the torque of the crankshaft 101 transmitted by the primary drive to the drive wheel 13 and from there to the conical gearwheel 3 is transmitted via the swashplate 5 to the driven element 4 and thus to the camshaft 11.

In order to maintain the phase position between the camshaft 11 and crankshaft 101, the adjustment shaft 16 is driven at the rotational speed of the drive wheel 13. If the phase position is to be changed, then the rotational speed of the adjustment shaft 16 increases or decreases depending on whether the camshaft 11 advances or lags relative to the crankshaft 101. Through the different rotational speed of the adjustment shaft 16, the swashplate 5 executes a wobbling rotation, wherein the angular ranges, in which the toothed rings 6, 7, 8, 10 engage each other, run around the swashplate 5, the conical gearwheel 3, and the driven element 4. In at least one of the toothed ring pairs 6, 7, 8, 10, the two intermeshing toothed rings 6, 7, 8, 10 have different numbers of teeth. If the angular ranges, in which the toothed rings 6, 7, 8, 10 intermesh, have completed one run, then an adjustment of the conical gearwheel 3 relative to the driven element 4 and thus the camshaft 11 relative to the crankshaft 101 is produced due to the difference in the number of teeth. The adjustment angle corresponds to the area that the teeth forming the difference in the number of teeth enclose.

It is possible for the intermeshing toothed rings 6, 7, 8, 10 of both toothed ring pairs to have different numbers of teeth. Thus, the adjustment reduction gear ratio is given from the two resulting reduction gear ratios.

It is likewise possible that the toothed rings 6, 7, 8, 10 have only one toothed ring pair with different numbers of teeth. The reduction gear ratio in this case is given only based on this speed reduction. The other toothed ring pair is used in this case only as coupling means with a reduction gear ratio of 1:1 between the swashplate 5 and the corresponding component 3, 4.

Between the attachment screw 12*a* and the hollow shaft 19 there is a ring channel 20, which is supplied with lubricant via a camshaft bearing 21. In the hollow shaft 19 there are a radial opening 22 and an impression 23, by means of which the ring channel 20 communicates with the hollow space 14*a* of the swashplate gear mechanism 2. The impression 23 is formed in the clamping surface 24 of the hollow shaft 19 and can be formed economically during the shaping process of the hollow shaft 19, wherein this can be taken into consideration in the shaping or sintering tool. The radial opening 22 can be, for example, stamped or tangentially punched out.

Between the impression 23 and the hollow space 14*a* there is a radial gap 25. The radial gap 25 acts as a diaphragm/choke for the lubricant flow. On one side, it allows its penetration into the hollow space 14*a*. On the other side, it ensures that sufficient lubricant is fed to the second roller bearings 18. By means of the widths a, b of the radial opening 25, the throttling effect of the radial gap 25 can be set selectively. Here, for example, widths less than or equal to 2 mm are provided.

To prevent the penetration of contaminant particles into the device 1, a lubricant filter can be arranged within the swashplate gear mechanism 2, in the camshaft 11, in the camshaft bearing 21, or before the feeding of the camshaft bearing 21.

During the adjustment process, the drive wheel 13 or the housing 14 rotates relative to the driven element 4, according to the gear transmission ratio of the swashplate gear mechanism 2 and the relative rotational speed of the adjustment shaft 16 to the drive wheel 13. An outer casing surface of the driven element 4 is formed as the first radial bearing surface 26. Furthermore, at least one part of an inner casing surface of the drive wheel 13 or the housing 14 is formed as a second radial bearing surface 27. The two radial bearing surfaces 26, 27 interact as a radial bearing 28, whereby the drive wheel 13 or the housing 14 is supported rotatably on the driven element 4.

Furthermore, in the shown embodiment, a contact plate 35 is locked in rotation with the drive wheel 3 or the housing 14. The contact plate 35 is constructed and arranged so that one of its axial side surfaces contacts the camshaft-facing axial side face of the driven element. These axial side surfaces interact as axial bearings 28*a*, which receive tilting moments or forces acting on the drive wheel 13 or the housing 14 and directed away from the camshaft 11.

In the embodiment shown in FIG. 1, the gearing of the fourth toothed ring 10 extends along the entire length of the gearing carrier 9, whereby the first radial bearing surface 26 is interrupted by the tooth gaps 29*a* of the gearing. Here, it can be provided that all or only special tooth gaps 29*a* interrupt the first radial bearing surface 26. These tooth gaps 29*a* are used as lubricant channels 29, by means of which the lubricant can be led to the radial bearing 28. Due to the high rotational speeds of the device 1 during the operation of the internal combustion engine 100, the centrifugal forces have the effect that lubricant is forced radially outwardly and led to the radial bearing 28 along the tooth gaps 29*a*. Therefore a sufficient supply of lubricant to the radial bearing 28 is guaranteed. In the shown embodiment, the second radial bearing surface 27 is formed as a perfect cylinder casing surface. Also conceivable would be forming lubricant pockets 31 in the second radial bearing surface 27. The lubricant pockets 31 communicate with the lubricant channels 29 and are used as a lubricant reservoir. Here, the lubricant pockets 31 can extend in the axial or peripheral direction. Also conceivable is the formation of a lubricant pocket 31 on the second radial bearing surface 27 in the form of a surrounding ring groove 32.

The lubricant supply to the axial bearing 28*a* is performed via the radial bearing 28.

Figure 2:
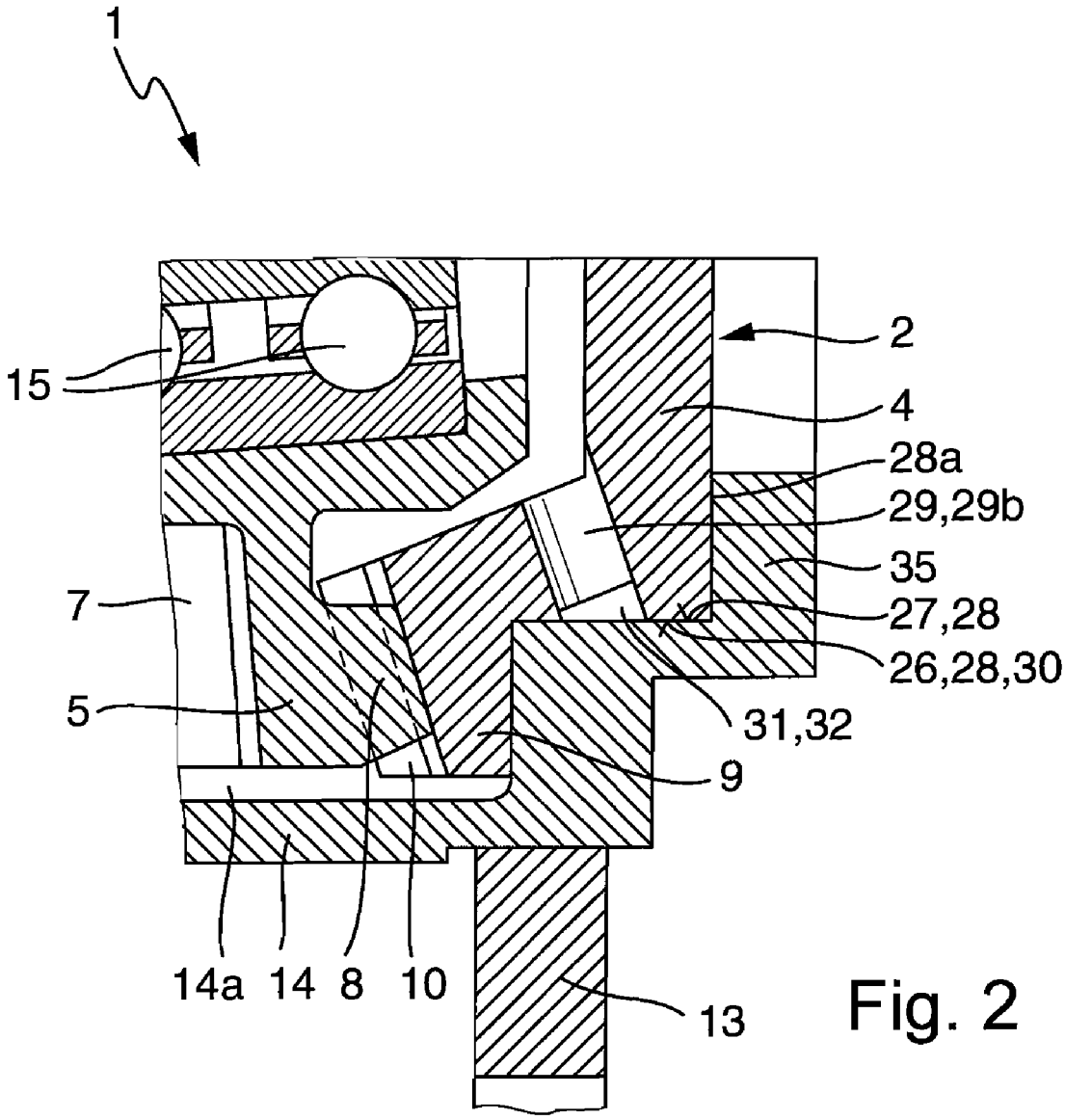

FIG. 2 shows a second embodiment of the invention, wherein only the region that is designated with the detail Z in FIG. 1 is shown in an enlarged representation. The second embodiment is identical to that shown in FIG. 1 for the most part, which is why only the section, in which the embodiments differ, was shown and described.

In contrast to the first embodiment, the housing 14 is supported not on the gearing carrier 9, but instead on a shoulder 30 formed on the driven element 4. The ring-shaped hollow space 14*a* of the swashplate gear mechanism 2 communicates with the radial bearing 28 by means of one or more lubricant channels 29 formed as bores 29*b*. Due to the high rotational speeds of the device 1 during the operation of the internal combustion engine 100, the centrifugal forces have the effect that lubricant is forced radially outwards and enters into the bore 29*b* and in this way is led to the radial bearing 28.

In addition, lubricant pockets 31, into which the bores 29*b* open, are formed in the first radial bearing surface 26. The lubricant pockets 31 are formed as grooves extending in the peripheral direction, wherein the cross section of the grooves can be rectangular or inclined for better processing of the bores 29*b*. They form a lubricant reservoir at the bearing position and thus support the formation of a lubricant film.

In addition to the formation of several lubricant pockets 31 spaced apart in the peripheral direction in the first radial bearing surface 26, an embodiment is also conceivable, in which a lubricant pocket 31 in the form of an ring groove 32 is formed on the first radial bearing surface 26. Also conceivable is providing the lubricant pockets 31 or the ring groove 32 on the second radial bearing surface 27.

Furthermore, with a suitable number of bores 29*b*, the formation of lubricant pockets 31 can be eliminated. The advantage in this case would be that no additional interruptions would be formed on the radial bearing surfaces 26, 27, which would simplify the formation of a closed lubricant film.

The driven element 4 contacts with its axial side surface facing away from the swashplate 5 at least partially the housing 14 or the contact plate 35 formed integrally with the housing 14, whereby an axial bearing 28*a* is formed. This axial bearing position receives forces or tilting moments acting on the drive wheel 13 or the housing 14 in the direction away from the camshaft 11. The lubricant supply of this axial bearing 28*a* is realized by means of the radial bearing 28.

Figure 3:
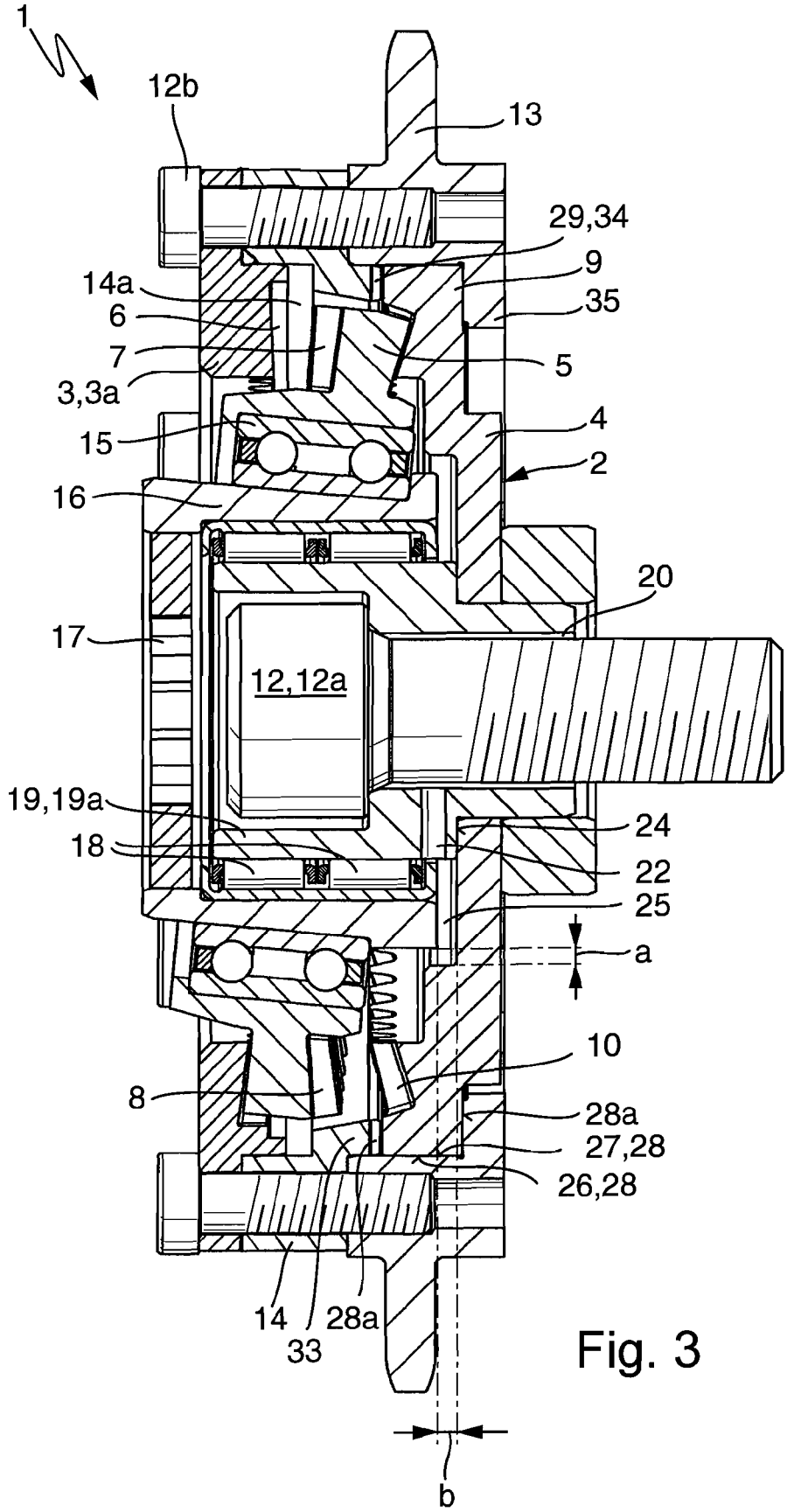

FIG. 3 shows a longitudinal section through a third embodiment of the device 1 according to the invention. In this embodiment, the drive wheel 13 is formed integrally with the stop plate 35. The separately produced housing 14 and the separately produced conical gearwheel 3 are connected to the drive wheel 13 by means of second attachment means 12*b*. On the outer casing surface of the gearing carrier 9, the driven element 4 forms a first radial bearing surface 26, on which the drive wheel 13 is supported by means of a second radial bearing surface 27 formed on this drive wheel. An axial side surface of the contact plate 35 forms, in turn, in interaction with the axial side surface of the gearing carrier 9 facing the camshaft 11, an axial bearing 28*a*, which supports forces acting on the drive wheel 13 in the direction away from the camshaft 11. The other axial side surface of the driven element 4 interacts with a projection 33 formed on the housing such that a second axial bearing 28*a* is formed, which supports forces acting on the drive wheel 13 in the direction of the camshaft 11. Here, a ring-shaped axial side surface of the projection 33 contacts the axial side surface of the gearing section 9. To supply both the radial bearing 28 and also the axial bearing 28*a* with lubricant, radially extending grooves 34 are formed in the axial side surface of the ring-shaped projection 33. These connect the hollow space 14*a* to the first radial bearing surface 26. Lubricant can now be led both into the radial bearing 28 and also to the axial bearing 28*a*. Here, lubricant is led along the radial bearing surfaces 26, 27 to the camshaft-side axial bearing 28*a*. Alternatively, the grooves 34 can be formed in the surface of the driven element 4 interacting with the projection 33.

The lubricant supply is realized in this embodiment also by a ring channel 20 formed between the attachment screw 12*a* and the hollow shaft 19. The ring channel 20 can be supplied, for example, with lubricant via a camshaft bearing 21. In the hollow shaft 19 there is a radial opening 22, for example, in the form of a bore, by means of which the ring channel 20 communicates with the hollow space 14*a* of the swashplate gear mechanism 2. Between the radial opening 22 and the hollow space 14*a* there is a radial gap 25. The radial gap 25 acts as a diaphragm/choke for the lubricant flow. On one side, it allows its penetration into the hollow space 14*a*. On the other side, it ensures that sufficient lubricant is also fed to the second roller bearings 18. The throttling effect of the radial gap 25 can be set selectively over the widths a, b of the radial opening 25. In this way, for example, widths less than or equal to 2 mm are provided. Advantageously, the second roller bearing 18 can at least partially cover the radial opening 22, which simplifies the feeding of lubricant into the second roller bearing.

Figure 4:
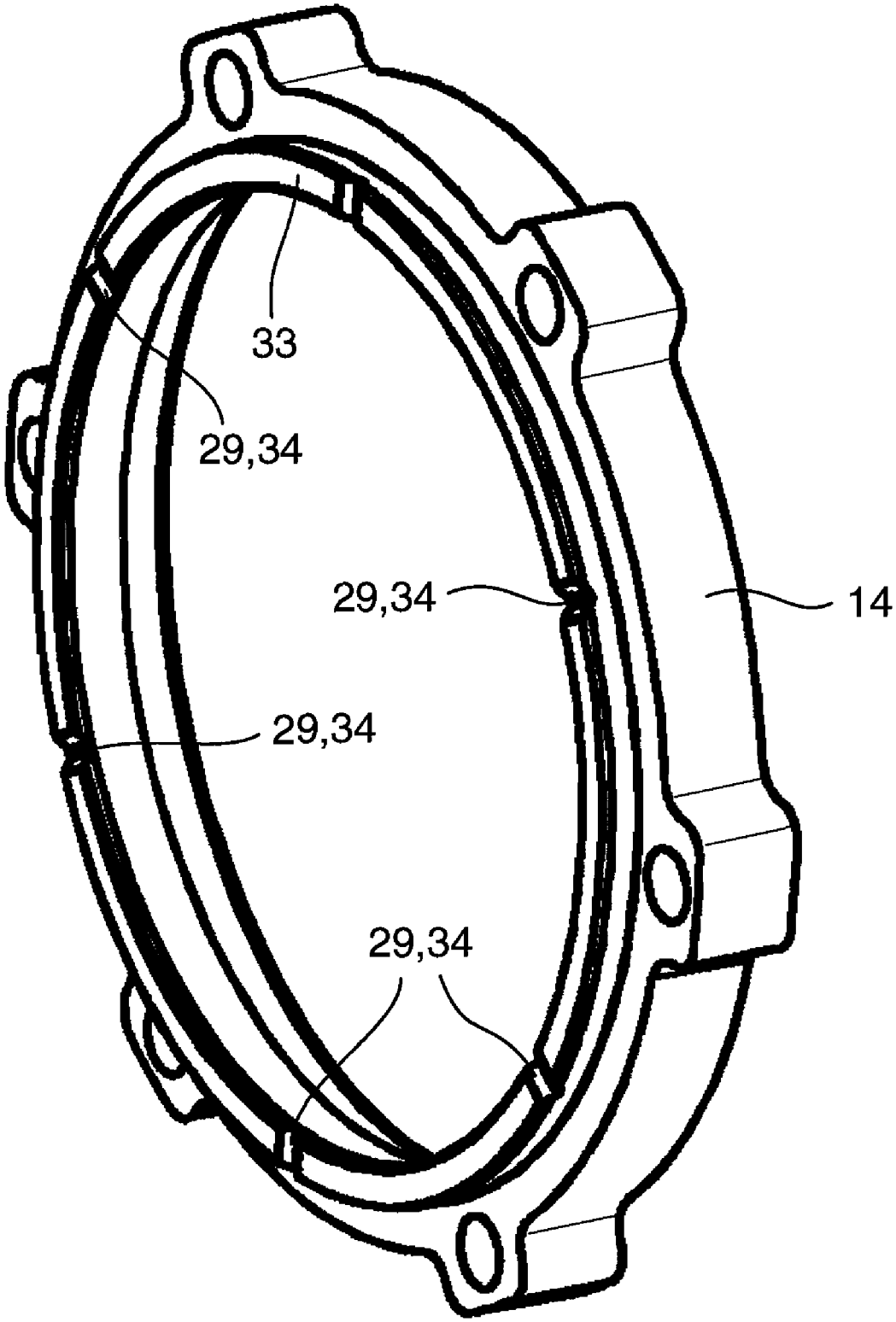

FIG. 4 shows a perspective view of the housing 14 from FIG. 3, with the radial grooves 34. As an alternative to the formation of the grooves 34 in an axial side surface of the projection 33 of the housing, these can also be formed on the axial side surface of the gearing carrier, which, in interaction with the projection 33, forms the axial bearing 28*a* facing away from the camshaft.

All of the embodiments have the advantage that the bores, which are described in the state of the art and which extend from the hub of the driven element to the radial bearing position, are replaced by structures, tooth gaps 29*a*, bores 29*b*, or axially extending grooves 34, which are simple and economical to produce. Therefore, the processing reliability is increased and the mounting expense is reduced, which leads overall to lower production costs. Furthermore, it is prevented that impurities, such as bore cuttings or shavings, remain in the lubricant channels 29.

LIST OF REFERENCE SYMBOLS

1 Device
2 Swashplate gear mechanism
3 Conical gearwheel
3*a* Component
4 Driven element
5 Swashplate
6 First toothed ring
7 Second toothed ring
8 Third toothed ring
9 Gearing carrier
10 Fourth toothed ring
11 Camshaft
12 First attachment means
12*a* Attachment screw
12*b* Second attachment screw
13 Drive wheel
14 Housing
14*a* Hollow space
15 First roller bearing
16 Adjustment shaft
17 Coupling element
18 Second roller bearing
19 Hollow shaft
19*a* Shaft
20 Ring channel
21 Camshaft bearing
22 Radial opening
23 Impression
24 Clamping surface
25 Radial gap
26 First radial bearing surface
27 Second radial bearing surface
28 Radial bearing
28*a* Axial bearing
29 Lubricant channel
29*a* Tooth gap
29*b* Bore
30 Shoulder
31 Lubricant pocket
32 Ring groove
33 Projection
34 Groove
35 Stop plate
100 Internal combustion engine
101 Crankshaft
102 Piston
103 Cylinder
104 Power-transmission means drive
105 Power-transmission means drive
106 Inlet camshaft
107 Outlet camshaft
108 Cam
109 Cam
110 Inlet gas-exchange valve
111 Outlet gas-exchange valve

The invention claimed is:

1. Device for modifying the control times of gas-exchange valves of an internal combustion engine comprising a drive wheel in driven connection with a crankshaft and a swashplate gear mechanism, which has at least one housing, a swashplate, and a driven element in driving connection with a camshaft, the housing and the driven element define a ring-shaped hollow space, in which the swashplate is arranged and at least one of the drive wheel or the housing is supported on a radial bearing which comprises a slide bearing so that it can rotate relative to the driven element via the slide bearing, a first radial bearing surface is formed on an outer casing surface of the driven element and a second radial bearing surface is formed on an inner casing surface of the housing or the drive wheel, and lubricant is fed from a region of the ring-shaped hollow space to the slide bearing through at least one lubricant channel formed as a bore in the driven element that connects the ring-shaped hollow space to the second radial bearing surface.

2. Device according to claim 1, wherein the lubricant channel opens into a lubricant pocket, which is formed in the first radial bearing surface, on a side of the slide bearing.

3. Device according to claim 2, wherein the lubricant pocket is formed as a ring groove, which extends around the first radial bearing surface in a peripheral direction.

4. Device according to claim 1, wherein the lubricant channel opens into a lubricant pocket, which is formed in the second radial bearing surface, on a slide bearing side, as a ring groove that extends around the second radial bearing surface in a peripheral direction.

5. Device for modifying the control times of gas-exchange valves of an internal combustion engine comprising a drive wheel in driven connection with a crankshaft and a swashplate gear mechanism, which has at least one housing, a swashplate, and a driven element in driving connection with a camshaft, the housing and the driven element define a ring-shaped hollow space, in which the swashplate is arranged and at least one of the drive wheel or the housing is supported on a radial bearing which comprises a slide bearing so that it can rotate relative to the driven element via the slide bearing, a first radial bearing surface is formed on an outer casing surface of the driven element and a second radial bearing surface is formed on an inner casing surface of the housing or the drive wheel, and lubricant is fed from a region of the ring-shaped hollow space to the slide bearing through at least one lubricant channel, which connects the ring-shaped hollow space to the second radial bearing surface and through which the lubricant is fed to the radial bearing, the lubricant channel comprising a radial groove that is formed in the housing or the driven element and extends from the first radial bearing surface to a hollow space.

* * * * *